US005820326A

United States Patent [19]

Melson

[11] Patent Number: 5,820,326

[45] Date of Patent: Oct. 13, 1998

[54] METHOD AND APPARATUS FOR MAKING A TAMPER-EVIDENT CROWN

[75] Inventor: Mark E. Melson, Cincinnati, Ohio

[73] Assignee: Product Investment, Inc., Cincinnati, Ohio

[21] Appl. No.: 627,756

[22] Filed: Mar. 29, 1996

[51] Int. Cl.[6] ..... B21D 5/06

[52] U.S. Cl. ..... 413/8; 413/56; 72/387

[58] Field of Search ..... 72/56, 62, 336, 72/339, 347, 348, 351, 389; 413/8, 24, 56

[56] References Cited

U.S. PATENT DOCUMENTS

| | | | |
|---|---|---|---|
| 105,146 | 7/1870 | Jeinsen . | |
| 1,229,572 | 6/1917 | Birnzweig . | |
| 1,711,795 | 5/1929 | Kinney . | |
| 1,766,217 | 6/1930 | Booth . | |
| 2,348,957 | 5/1944 | Carvalho . | |
| 3,543,559 | 12/1970 | Hawkins et al. | 413/8 X |
| 3,695,201 | 10/1972 | Frankenberg | 72/348 X |
| 4,002,049 | 1/1977 | Randolph, Sr. . | |
| 4,181,002 | 1/1980 | Eckhold et al. . | |
| 4,365,500 | 12/1982 | Klukow . | |
| 4,387,583 | 6/1983 | Martin et al. . | |
| 4,434,644 | 3/1984 | Gargrave et al. . | |
| 4,516,420 | 5/1985 | Bulso, Jr. et al. | 72/339 X |
| 4,535,619 | 8/1985 | Gargrave . | |
| 4,562,721 | 1/1986 | Bleyer . | |
| 4,782,969 | 11/1988 | Henning . | |
| 5,263,600 | 11/1993 | Henning . | |
| 5,309,749 | 5/1994 | Stodd | 72/336 |
| 5,341,669 | 8/1994 | Katz . | |
| 5,361,620 | 11/1994 | Meadows . | |
| 5,404,742 | 4/1995 | Wilson et al. . | |

*Primary Examiner*—Joseph J. Hail, III
*Assistant Examiner*—Anthony Ojini
*Attorney, Agent, or Firm*—Wood, Herron & Evans, LLP

[57] ABSTRACT

Method and apparatus are disclosed for making a tamper-evident crown from a sheet of material. The tamper-evident crown includes a top wall, a depending peripheral flange, and a plurality of tabs bent inwardly from a lower circumferential edge of the flange and preferably toward the top wall. The tamper-evident crown is formed in a die structure having upper and lower die sets mounted in a conventional die press for relative movement toward each other. One of the die sets includes a plurality of bending members being movable responsive to the relative movement of the upper and lower die sets toward each other and bending the tabs inwardly toward each other and preferably slightly toward the top wall during formation of the crown.

44 Claims, 7 Drawing Sheets

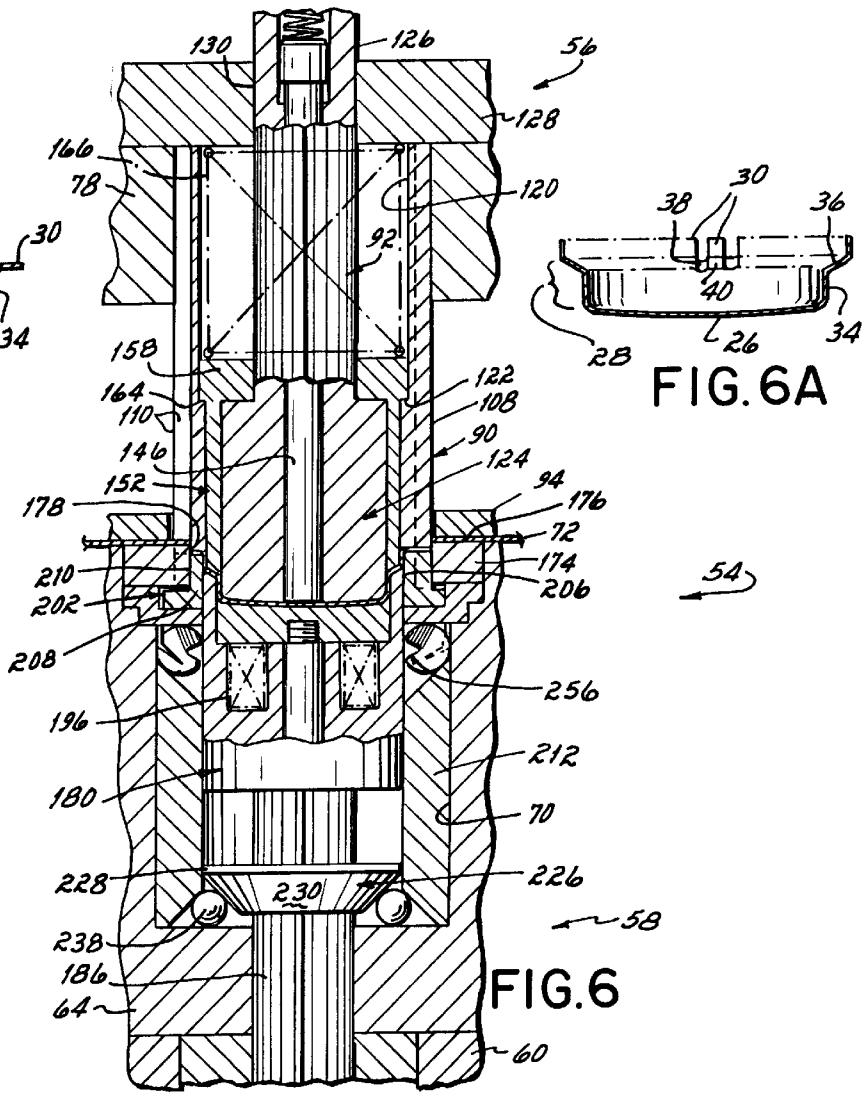
FIG.6A
FIG.6
54
56
58
60
64
26
28
30
34
36
38
40
70
72
78
90
92
94
108
110
120
122
124
126
128
130
146
152
158
164
166
174
176
178
180
186
196
202
206
208
210
212
226
228
230
238
256
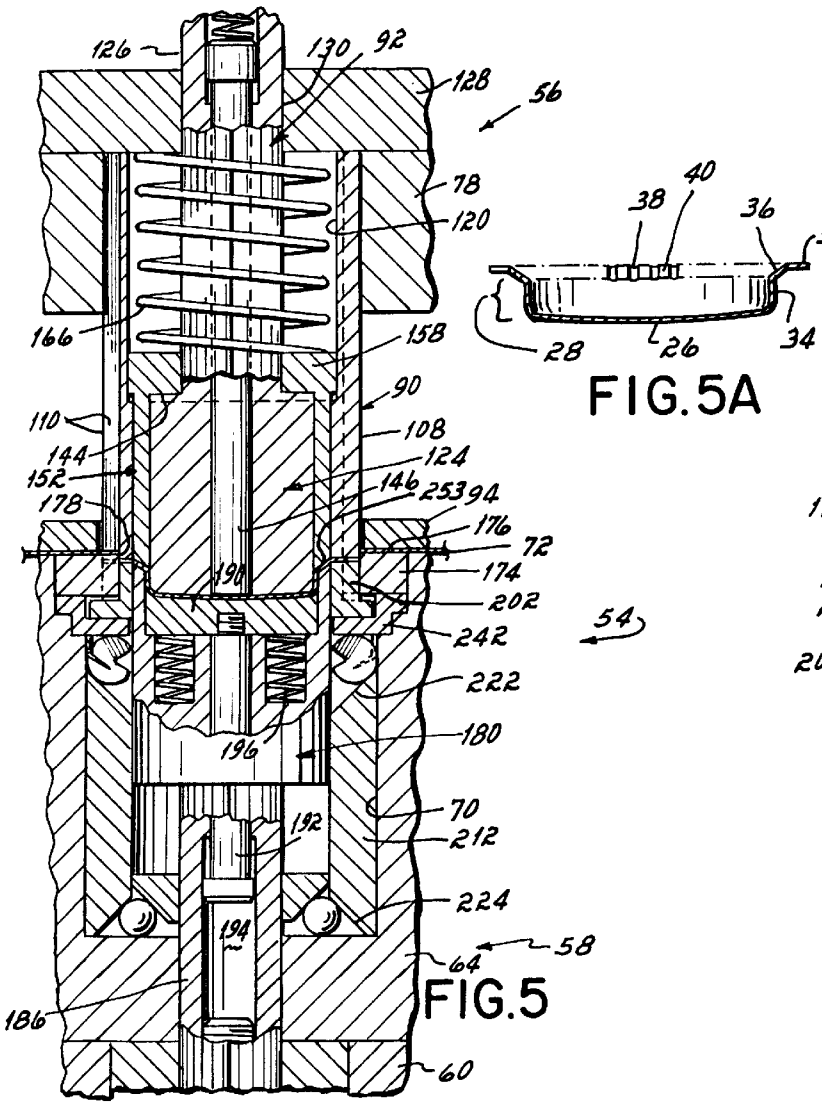
FIG.5A
FIG.5
54
56
58
60
64
26
28
30
34
36
38
40
70
72
78
90
92
94
108
110
120
124
126
128
130
144
146
152
158
166
174
176
178
180
186
191
192
194
196
202
212
222
224
242
253

METHOD AND APPARATUS FOR MAKING A TAMPER-EVIDENT CROWN

FIELD OF THE INVENTION

The present invention relates generally to the manufacture of crown-type closures for use on the mouth or finish of containers such as glass or plastic bottles. More particularly, the invention relates to a novel method and apparatus for making a tamper-evident crown having a plurality of inwardly bent tabs which provide a readily discernable indication that the crown has been previously removed from the bottle or container.

BACKGROUND OF THE INVENTION

The method and apparatus of the present invention are particularly adapted for making a tamper-evident crown for use with a novel container, each having the design features and advantages as disclosed in pending application U.S. Ser. No. 08 /398,430 filed Mar. 6, 1995 by John C. Henning for "Tamper-Evident Closure System" which is incorporated herein by reference in its entirety. That application discloses a closure system which is an improvement upon the closure construction shown in Henning U.S. Pat. No. 5,263,600 for "Tamper-Evident Twist-Off Closure" as well as earlier Henning U.S. Pat. No. 4,782,969 for "Twist-Off Bottle Cap".

The tamper-evident crown-type closure disclosed in pending application Ser. No. 08/398,430 and made by the method and apparatus of this invention has a generally circular top wall and a depending peripheral flange having a vertical wall portion and a lower flared portion. A plurality of ribs and a plurality of webs interconnecting the ribs are formed in the lower flared portion of the peripheral flange. The depending peripheral flange carries a plurality of tabs which are formed along a lower circumferential edge of the lower flared portion between the spaced ribs formed in the flange.

The tabs thus extend from the webs and are directed inwardly toward the top wall so they form an included acute angle with the webs from which they extend when the crown is applied to a bottle finish.

In considering the performance of such crown-type closures, the fit of the formed crown on the features of the bottle finish is important to its commercial use. Bottlers, for example, require the crowns to be releasable with a twist-off torque which is consistently the same from crown to crown. Also, the crowns must consistently resist the pressure exerted by the contents in the bottle to prevent pop-offs.

Prior to this invention, formation of such crowns required several secondary forming operations. Not only must a crown blank be cut and then formed into the top wall, flange, ribs and webs, but the tabs must be bent inwardly toward each other and, preferably, slightly toward the top wall.

In order to enhance the commercial feasibility and production rate of the crowns described, it is desirable that the crown blanks be cut and formed all in a single strike operation. Also, it is preferably desired that multiple blanks are cut from a flat blank feed stock in very close patterned relationship, reducing blank stock waste and, indeed, producing a waste matrix which itself has other useful applications. When the blanks are formed from a flat sheet, it is thus preferable to have only a few thousandths of an inch between the outer-most borders or peripheries of each of the blanks. When the blanks are simultaneously cut from a flat sheet at the same time, it is thus desirable to be able to gang or place multiple dies closely enough to produce the smallest feasible spacing between each blank periphery (such as, for example, between about 0.050" and about 0.100"), but this purpose is extremely difficult to achieve where a single strike is desired to produce the fully completed crown, ready for capping. The necessity of bending the tabs inwardly toward each other and preferably continuing slightly toward the top wall makes the single strike, closely spaced cut and form operation a very difficult procedure to accomplish.

Accordingly, it has been one objective of the present invention to provide methods and apparatus for cutting and forming a tamper-proof crown as described in a single strike operation.

A further objective of the invention has been to provide methods and apparatus for forming a plurality of the described crowns in a single strike from a flat closure stock feed sheet with minimal distance between each blank periphery cut from the sheet.

Another objective of this invention to provide a novel method and apparatus for making a formed tamper-evident crown-type closure having a top wall, a depending peripheral flange, and a plurality of tabs bent inwardly from a lower edge of the flange, and preferably slightly toward the top wall.

Another objective of this invention is to provide an improved ganged matrix or pattern of die apparatus for making a plurality of the formed tamper-evident crowns with minimal waste of the feed stock material.

A further objective of the invention has been to provide improved die apparatus for making the described crown.

SUMMARY OF THE INVENTION

To these ends, the present invention contemplates a novel die structure and method for making a tamper-evident crown-type closure having a top wall, a depending peripheral flange, and a plurality of tabs bent inwardly from a lower circumferential edge of the flange toward each other and preferably slightly beyond parallel toward the top wall.

The die structure of this invention comprises upper and lower die sets mounted in a conventional die press. The upper and lower die sets are movable with respect to each other for making the formed crown from a sheet of feed stock material. The upper die set overlies and is in register with the lower die set for cooperation during relative movement of the die sets toward each other to make the tamper-evident crown.

In a preferred embodiment, the lower die set includes a crown forming body mounted within a die support cavity for movement in a first direction in response to the relative movement of the upper and lower die sets toward each other. A driving member is mounted within the die support cavity and is responsive to movement of the crown forming body in the first direction for movement in a second direction within the die support cavity.

In accordance with the invention, a plurality of movable bending members are mounted within the die support cavity. The movable bending members are responsive to movement of the driving member in the second direction and bend the plurality of tabs inwardly and preferably slightly toward the top wall during formation of the tamper-evident crown.

Preferably, a plurality of the upper and lower die sets are ganged together in a cooperative matrix or pattern for making a plurality of the formed tamper-evident crowns from a sheet of material supported between the upper and lower die sets. To reduce waste of the feedstock material, each of the upper and lower die sets include operative components which preferably have an outer periphery of an extent no greater than the outer periphery of the flat blank cut from the feedstock.

During manufacture of the crown using the method and apparatus of this invention, the plurality of tabs are bent inwardly from the webs at the lower circumferential edge of the peripheral flange toward each other and preferably continuing slightly toward the top wall of the crown during a single strike of the die apparatus. The tamper-evident crown formed by the method and apparatus of the present invention is readily adapted to be applied to a container by conventional capping machinery, where the tabs are bent even further toward the top wall.

The invention will be more readily understood from a consideration of the following detailed description of the drawings illustrating a preferred embodiment of the invention.

BRIEF DESCRIPTION OF THE DRAWINGS

FIG. 5 is a view similar to FIG. 4 showing the die structure during an intermediate crown forming operation;

FIG. 5A is a cross-sectional view of the crown made by operation of the die structure shown in FIG. 5;

FIG. 6 is a view similar to FIG. 5 showing the die structure during a later intermediate crown forming operation;

FIG. 6A is a cross-sectional view of the crown made by operation of the die structure shown in FIG. 6;

DETAILED DESCRIPTION OF THE INVENTION

Figure 1:
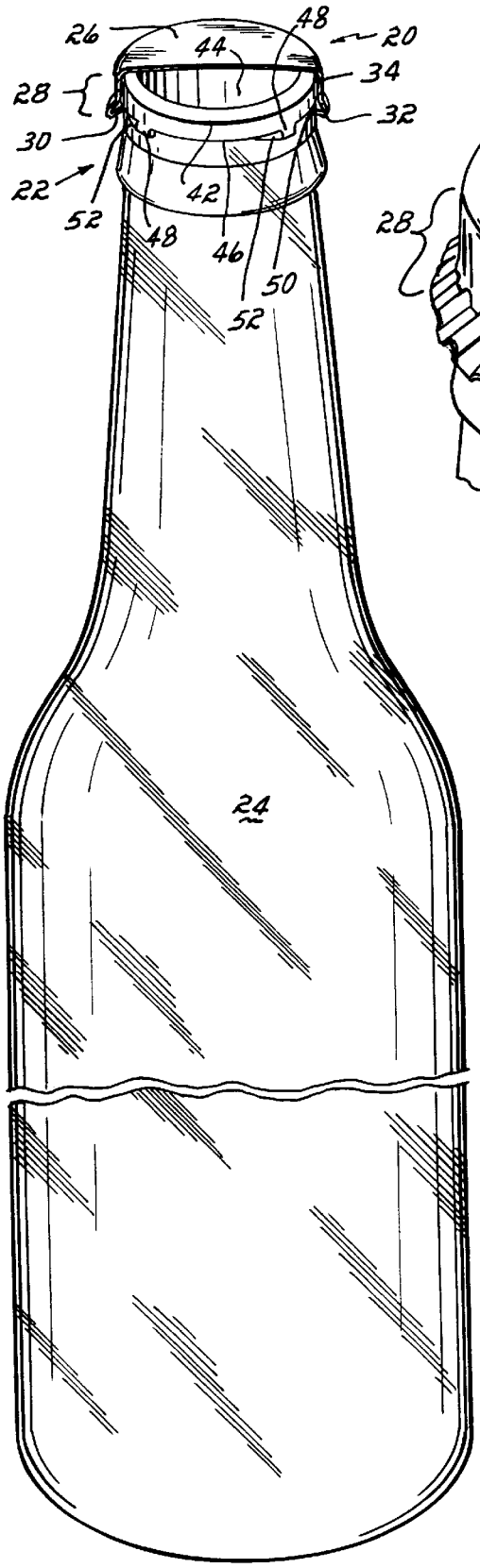
FIG. 1 is a perspective view, partially broken away, of a tamper-evident crown manufactured by the method and apparatus of the present invention and applied by conventional capping machinery to a bottle top.
Figure 1A:
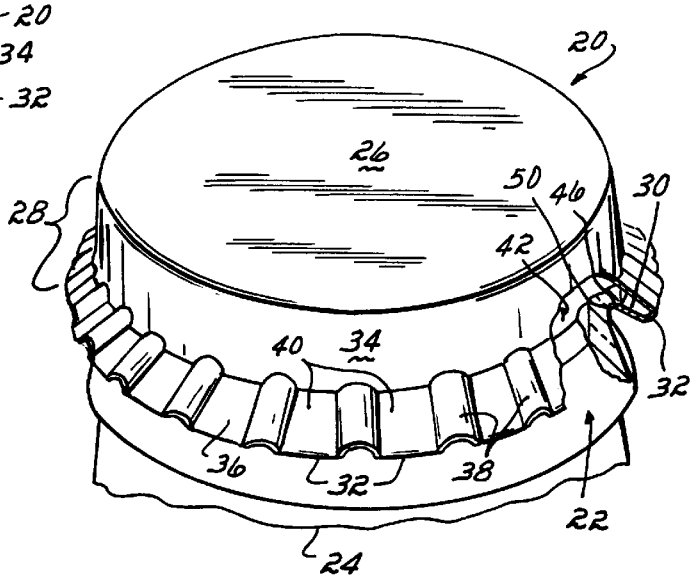
FIG. 1A is an enlarged fragmentary perspective view of the tamper-evident crown and bottle top of FIG. 1.
Figures 7, 8, 9:
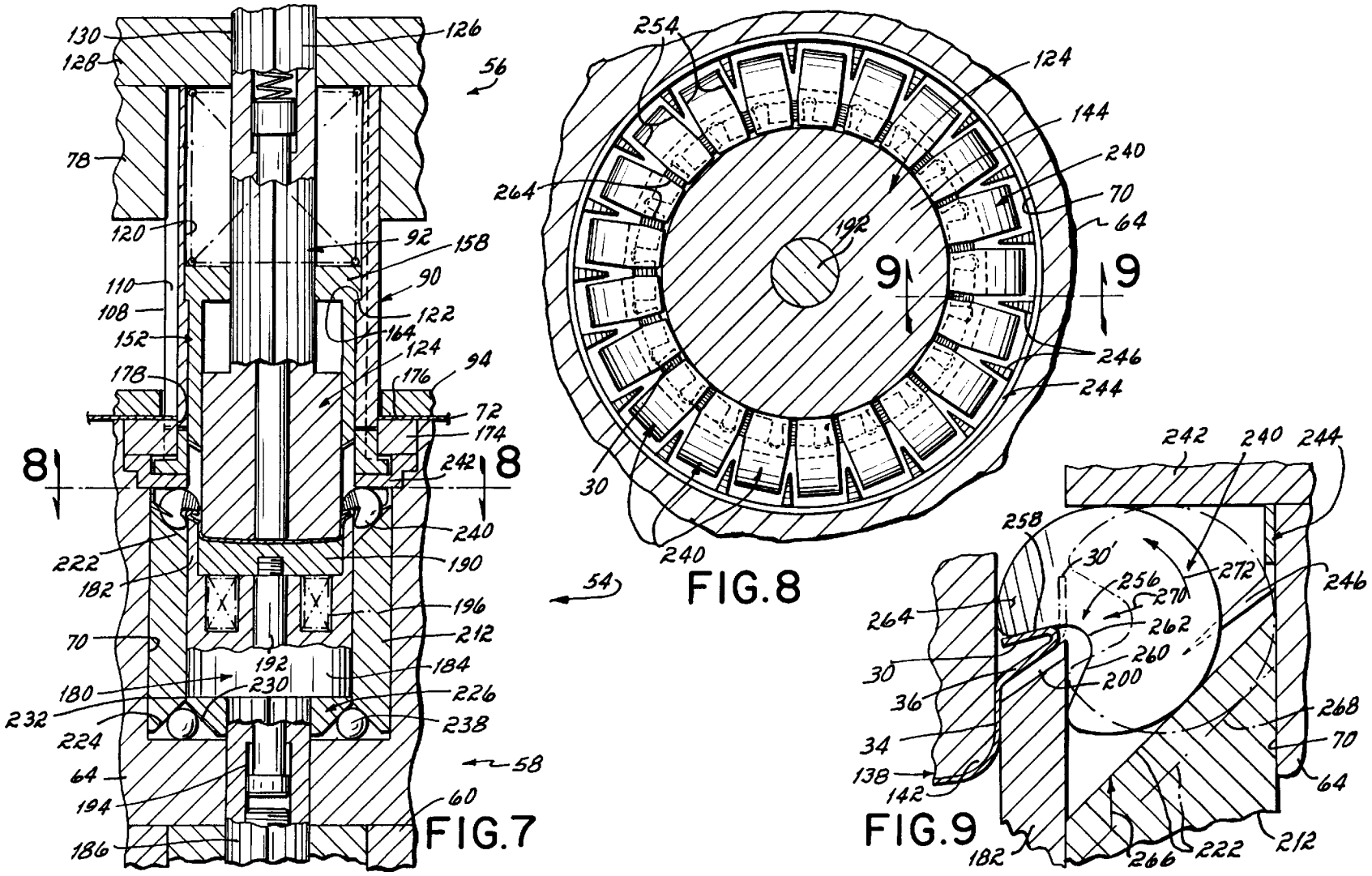
FIG. 7 is a view similar to FIG. 6 showing the die structure at the completion of the crown forming operation.
FIG. 8 is a cross-sectional view taken along lines 8—8 in FIG. 7 showing the position of a series of circumferentially spaced rotary benders at the completion of the crown forming operation.
FIG. 9 is a fragmentary cross-sectional view taken along lines 9—9 in FIG. 8 illustrating movement of the rotary benders during the crown forming operation.

Reference is now made to FIGS. 1 and 1A of the drawings which illustrate an exemplary tamper-evident crown 20 made by the method and apparatus of the present invention. FIG. 9 also illustrates a portion of the crown 20 in cross-section at the left side of the figure. Crown 20 is designed to be applied to a finish 22 of a bottle or container 24 and comprises a generally circular top wall 26, a depending peripheral skirt or flange 28, and a plurality of tabs 30 bent inwardly from a lower circumferential edge 32 of the peripheral flange toward the top wall of the closure when the crown is applied.

As is generally conventional with crown-type closures, the peripheral flange 28 includes a substantially vertical wall portion 34 and an integral flared lower portion 36 terminating at the lower circumferential edge 32. A plurality of ribs 38 having a generally U-shaped cross-section are formed in the flared lower portion 36 of the peripheral flange 28 and a plurality of webs 40 are formed between and interconnecting the vertical ribs.

For purposes of description only it is considered that top wall 26 as shown in the drawings is generally horizontally oriented, while flange 28 is generally vertically oriented. These references to "vertical" or "horizontal" orientation are used herein only to indicate general orientation of parts relative to each other and are not to be construed as limiting the structure of the crown or that of the die structure described herein, or its function in any way.

The finish 22 of bottle 24 includes a peripheral lip 42 surrounding a pouring opening 44 and an annular ledge 46 disposed below the lip. The finish 22 preferably includes a plurality of cams 48 formed about the periphery of the finish and having a construction which is described in greater detail in pending application U.S. Ser. No. 08/398,430 by John C. Henning, incorporated herein by reference, to which the reader is referred. Crown 20 is placed over the end of finish 22 and is locked in position surrounding lip 42 by conventional capping machinery which brings transverse edges 50 of the tabs 30 into engagement with the annular ledge 46. Crown 20 is adapted to be removed by manually twisting the crown and thereafter lifting the crown from the end of the finish 22. As the crown 20 is rotated through 90°, for example, the tabs 30 are cammed outwardly by working surfaces 52 on the cams 48. Once removed, the crown 20 will provide a user with a readily observable indication that the bottle 24 has previously been opened as the tabs 30 cannot be bent inwardly to return to their original locked position.

The crown 20 is preferably made using the apparatus and method of this invention, which is designated generally by the reference numeral 54 in each of FIGS. 2–7 of the drawings. During manufacture of the crown 20 in accordance with the method and apparatus of this invention, the tabs 30 are bent inwardly toward each other from the webs 40 at the lower circumferential edge 32 of the peripheral flange 28. Preferably, the tabs 30 are bent inwardly parallel to or slightly beyond but essentially parallel to the top wall 26 of the closure on crown forming and later bent further toward the top wall on application to the bottle finish 22. Bending of the tabs 30 is accomplished by a variety of cooperating die parts which will be described in greater detail below with reference to a preferred embodiment of this invention.

Figure 2:
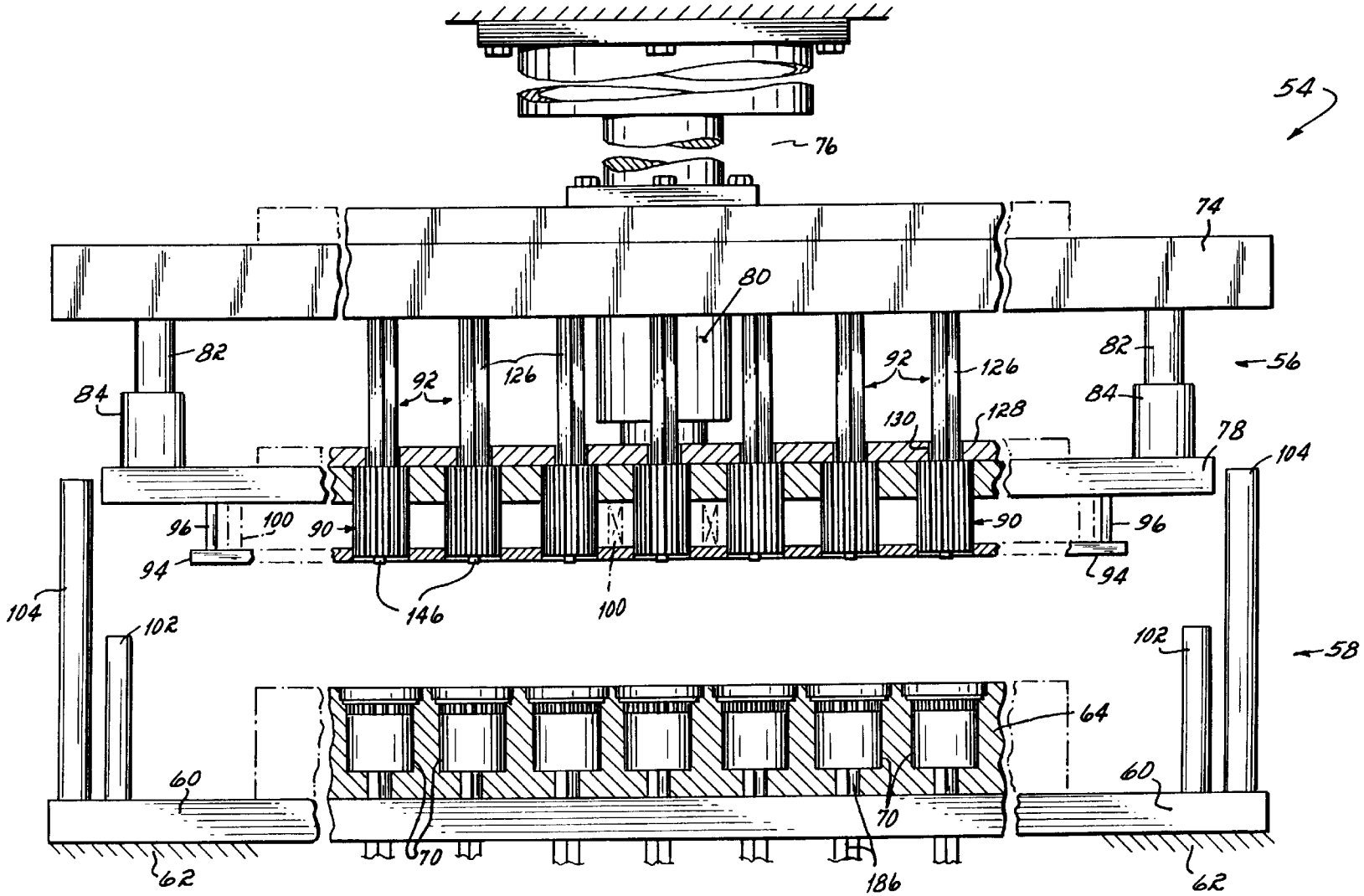
FIG. 2 is a side elevational view of a matrix of die structures of the present invention arranged in a die press, illustrating the position of the various operative components prior to a crown forming operation.

Referring to FIG. 2, apparatus 54 for making a plurality of tamper-evident crowns 20 having the design features as set forth above is shown comprising cooperating upper and lower die sets 56 and 58, respectively, mounted in a die press of conventional design. In operation of the die press, the upper die set 56 is mounted for reciprocatory vertical movement relative to the fixed lower die set 58 for making the formed crown 20 as shown most clearly in FIGS. 1 and 1A.

The lower die set 58 comprises a stationary die shoe 60 mounted at a lower end 62 of the die press having a standard construction. A die support 64 is rigidly mounted to the stationary die shoe 60 through threaded fasteners 66 (see FIG. 3) extending through bores 68 in the die shoe. As will be described in more detail below, the die support 64 preferably includes a plurality of die support cavities 70 ganged together in a matrix or pattern for making a plurality of the tamper-evident crowns 20 from a sheet of material 72 (see FIGS. 4–7) supported between the upper and lower die sets 56 and 58 with minimal waste of the material.

Upper die set 56 includes a head punch drive plate 74 mounted at the other, of the die press through a reciprocatory stem 76 as will be appreciated by those skilled in the art. A blanking punch drive plate 78 is yieldably mounted to the head punch drive plate 74 preferably through a gas cylinder spring 80 mounted between the plates. The head punch and blanking punch drive plates 74 and 78 are maintained in proper alignment through pins 82 mounted to the head punch drive plate which are slidably received within guideways 84 (see FIGS. 2 and 3) in the blanking punch drive plate. Each of the guideways 84 includes a wear bushing or sleeve 86 suitably fixed to an inner cylindrical surface 88 of the guideway for cooperation with the pins 82.

As shown in FIG. 2, the upper die set 56 preferably includes a plurality of blanking punches 90 mounted to the blanking punch drive plate 78 and a plurality of head punches 92 mounted to the head punch driving plate 74 for vertical movement in the blanking punches. The blanking punches 90 and head punches 92 overlie and are in register with the die support cavities 70 of the lower die set 58 for making a plurality of the tamper-evident crowns 20 during vertical movement of the upper die set 56 toward the lower die set as will be described in more detail below.

Figure 3:
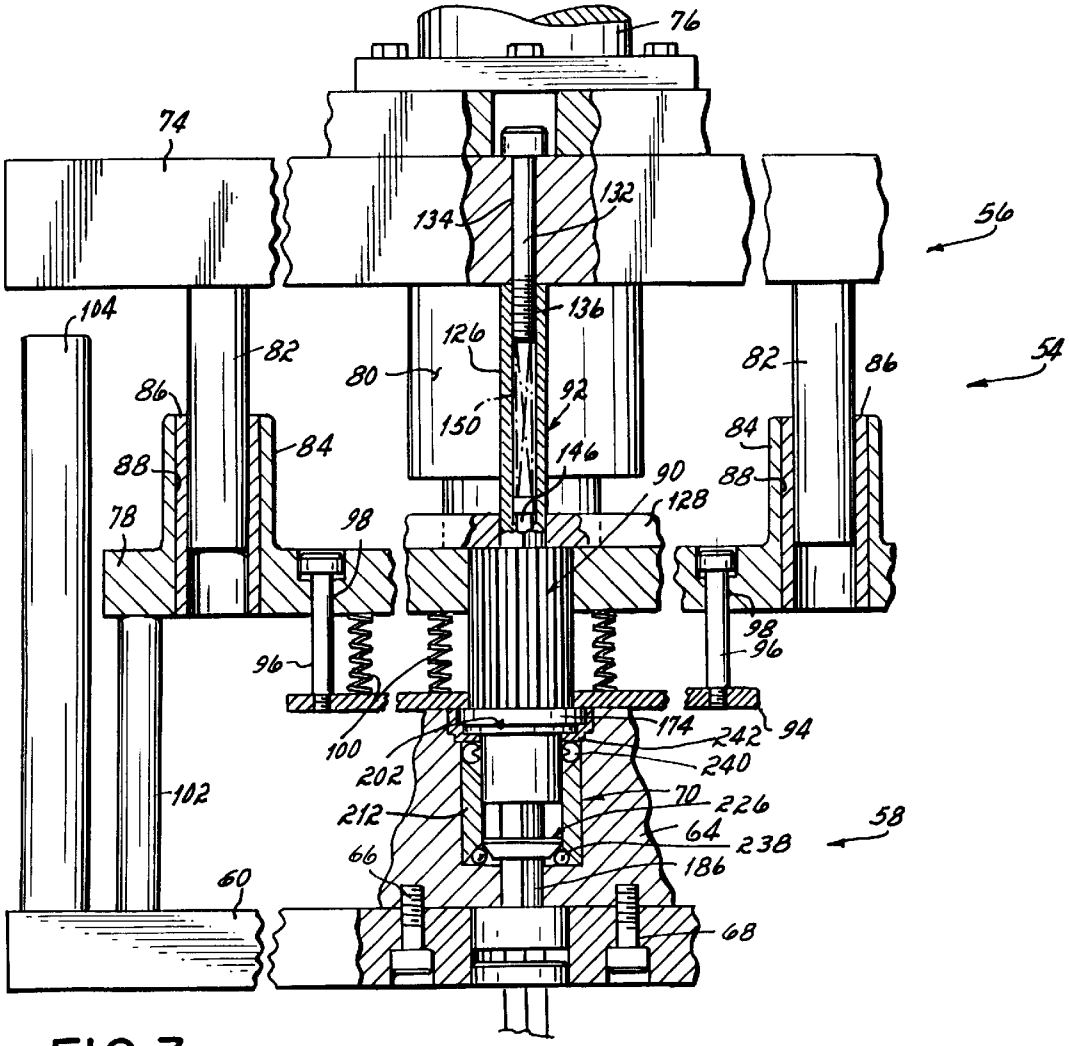
FIG. 3 is an enlarged side elevational view, partially broken away and in cross-section, of a die structure during a crown blanking operation, illustrating the position of the various operative components at the completion of the blanking operation.

A stripper plate 94 is yieldably mounted to the blanking punch drive plate 78 through a plurality of fasteners 96 extending through bores 98 in the blanking punch drive plate (see FIG. 3). A plurality of springs 100 are mounted between the stripper plate 94 and the blanking punch drive plate 78. The stripper plate 94 is provided to maintain the sheet of material 72 stationary between the upper and lower die sets 56 and 58 during operation of the apparatus 54 in making the crowns 20.

As shown in most clearly in FIGS. 2 and 3, the lower die set 58 includes pins 102 mounted to the stationary die shoe 60 for limiting vertical movement of the blanking punch drive plate 78 toward the lower die set at the completion of a blanking operation to be discussed in more detail below in relation to FIGS. 3, 4 and 4A. The stationary die shoe 60 further includes pins 104 for limiting vertical movement of the head punch drive plate 74 toward the lower die set 58 at the completion of the crown forming operation to be discussed in more detail below with reference to FIG. 7.

In operation of the upper die set 56 during manufacture of a crown 20, the reciprocatory stem 76 of the die press imparts vertical movement to the head punch drive plate 74 toward the lower die set 58. The blanking punch drive plate 78 moves simultaneously with the head punch drive plate 74 as the gas cylinder spring 80 transmits the vertical movement of the head punch drive plate to the blanking punch drive plate. Vertical movement of the blanking punch drive plate 78 terminates at the completion of a blanking operation when the blanking punch drive plate abuts the pins 102 mounted to the stationary die shoe 60 as shown in FIG. 3.

Figure 4A:
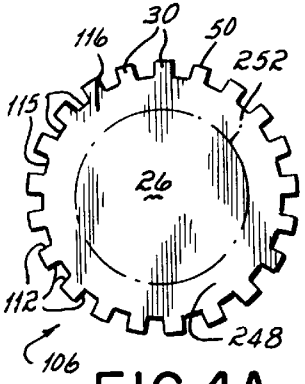
FIG. 4A is a top plan view of a crown blank made by operation of the die structure as shown in FIGS. 3 and 4.
Figure 4:
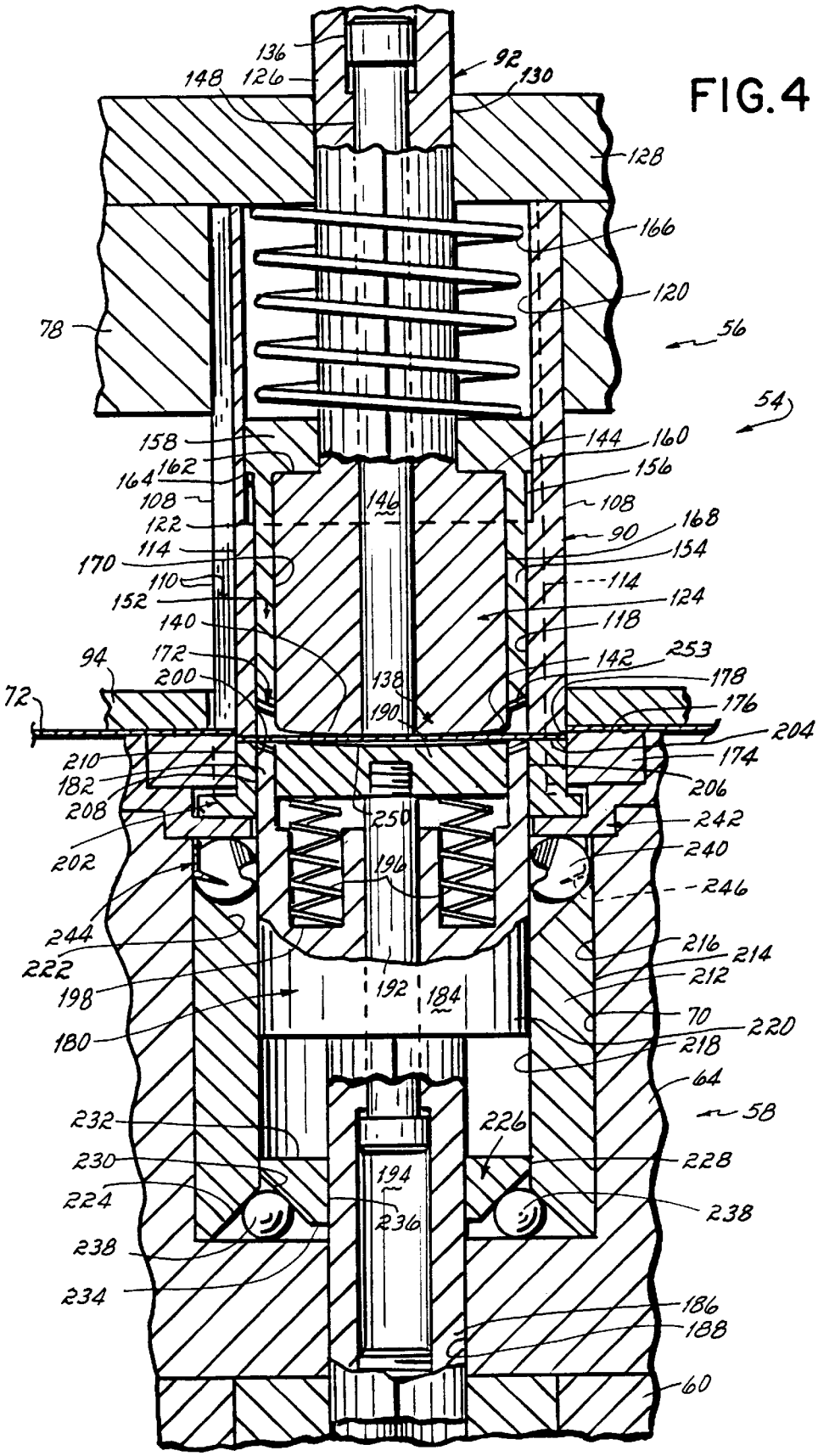
FIG. 4 is an enlarged view, partially broken away and in cross-section, of the die structure shown in FIG. 3 at the completion of the crown blanking operation.

Referring to FIGS. 3 and 4, the construction and operation of the upper and lower die sets 56 and 58 are shown in greater detail at the completion of a blank forming operation to form a flat blank 106 as shown in FIG. 4A. The upper die set 56 includes a blanking punch 90 rigidly mounted to the blanking punch drive plate 78. Each blanking punch 90 has an outer cutting surface 108 having edges 110 corresponding to side edges 112 and transverse edges 50 of the tabs 30 formed in the flat blank 106. The blanking punch 90 further includes edges 114 which correspond to a circumferential edge 115 of the flat blank 106 which defines a generally circular portion 116 of the blank. The blanking punch 90 has cylindrical inner surfaces 118 and 120 of different diameters which join at a horizontal ledge or shelf 122 within the blanking punch.

Each reciprocatory head punch 92 includes a generally cylindrical head 124 at one end which is integral with or attached to a keyed shaft 126 of preferably square configuration. The keyed shaft 126 extends from the cylindrical head 124 through a key plate 128 mounted to the blanking punch drive plate 78. The key plate 128 includes a plurality of keyed apertures 130 for slidably guiding the keyed shafts 126 of the head punches 92 during vertical movement of the head punches within the blanking punches 90. The keyed shaft 126 is attached to the head punch driving plate 74 at a remote end of the shaft through a threaded fastener 132 extending through a bore 134 in the head punch drive plate and received in a threaded bore 136 in the keyed shaft (see FIG. 3).

The head punch 92 preferably includes a forming surface 138 having an arcuate portion 140 and a rounded shoulder portion 142 circumscribing the arcuate portion. The configuration of the arcuate portion 140 and the rounded shoulder portion 142 preferably corresponds to the desired configuration of the top wall 26 of the crown 20. The head punch 92 further has an annular horizontal shelf 144 at the juncture of the keyed shaft 126 with the cylindrical head 124. An ejector pin 146 is supported within a bore 148 in the keyed shaft 126 and is outwardly biased through the forming surface 138 of the head punch 92 through a helical spring 150 (see FIGS. 3 and 5–7) supported within the threaded bore 136.

A scallop ring 152 is slidably mounted within the blanking punch 90 for partial vertical movement in cooperation with vertical movement of the head punch 92 within the blanking punch. The scallop ring 152 includes an annular portion 154 having an outer cylindrical surface 156 for sliding engagement with the cylindrical inner surface 118 of the blanking punch 90. The scallop ring further includes an annular collar 158 at one end of the annular portion 154 having an outer cylindrical surface 160 for sliding engagement with the cylindrical inner surface 120 of the blanking punch 90. A horizontal shoulder 162 is provided on the annular collar 158 for abutment with the annular horizontal shelf 144 of the head punch 92. The outer cylindrical surfaces 156 and 160 of the scallop ring 152 join at a horizontal ledge or shelf 164 disposed below the annular collar 158 of the scallop ring. A helical spring 166 is provided about the keyed shaft 126 in the blanking punch 90, between the key plate 128 and the annular collar 158 of the scallop ring 152, for urging the scallop ring in the same direction with the head punch 92 during vertical movement of the head punch within the blanking punch.

As will be described in more detail below with reference to FIG. 6, the horizontal shelf 164 of the scallop ring 152 cooperates with the horizontal shelf 122 of the blanking punch 90 to limit vertical movement of the scallop ring within the blanking punch as the head punch 92 travels vertically within the blanking punch. For this purpose, the cylindrical head 124 of the head punch 92 has an outer cylindrical surface 168 for sliding engagement with an inner cylindrical surface 170 of the scallop ring 152. The annular portion 154 of scallop ring 152 preferably has a forming surface 172 for purposes to be described in more detail below in relation to FIGS. 5 and 6.

With further reference to FIGS. 3 and 4, the lower die set 58 of apparatus 54 includes an annular blanking member 174 supported above the die support cavity 70. The blanking member 174 has a horizontal surface 176 for supporting the sheet of material 72 during a blanking operation and an inner cutting surface 178 conforming in shape with and cooperating with the outer cutting surface 108 of the blanking punch 90 during vertical movement of the blanking punch toward the blanking member. The blanking punch 90 and the blanking member 174 cooperate for cutting the flat blank 106 shown in FIG. 4A from the sheet of material 72 supported between the upper and lower die sets 56 and 58.

A scallop body 180 is mounted for vertical movement within the die support cavity 70 and includes an annular portion 182 and a cylindrical body portion 184. The scallop body 180 is integral with or attached to a keyed shaft 186 extending through a keyed aperture 188 in the die support 64. Vertical movement of the scallop body 180 within the die support cavity 70 is controlled by an air cylinder of conventional design (not shown) mounted at a remote end of the keyed shaft 186 as will be described in more detail below. A spring biased support pad 190 is mounted for vertical movement within the annular portion 182 of the scallop body 180 through a threaded fastener 192 slidably supported in a bore 194 within the keyed shaft 186. A plurality of springs 196 are provided in cavities 198 within the cylindrical body portion 184 to urge the support pad 190 toward the head punch 92. The annular portion 182 of the scallop body 180 is preferably frusto-conically shaped at one end and includes a plurality of rib projections and a plurality of web depressions, shown generally by reference numeral 200, for forming the ribs 38 and webs 40 on the peripheral flange 28 of the crown 20 as will be described in more detail below with reference to FIG. 5.

For purposes to be described in relation to FIG. 6, a draw ring 202 is provided having a horizontal surface 204 disposed below the horizontal surface 176 of the blanking member 174 and a forming surface 206 disposed inwardly of the inner cutting surface 178 of the blanking member. Preferably, the forming surface 206 of the draw ring 202 has a vertical surface 208 corresponding to the cylindrical inner surface 118 of the blanking punch 90. The draw ring 202 has an outer vertical surface 210 corresponding to the outer cutting surface 108 of the blanking punch and the inner cutting surface 178 of the blanking member 174.

As will be described in more detail with reference to FIGS. 7 and 9, an annular driving ring 212 is provided for vertical movement in the die support cavity 70 and has an outer cylindrical surface 214 for sliding engagement with a cylindrical surface 216 of the die support cavity. The driving ring 212 has an inner cylindrical surface 218 for sliding engagement with a cylindrical surface 220 of the scallop body 180. Cam surfaces 222 and 224 are provided at either end of the driving ring 212 for purposes to be described in detail below.

In one embodiment, a free floating cam driver 226 is provided beneath the scallop body 180 for vertical movement within the die support cavity 70. The cam driver 226 is adapted for vertical movement in the die support cavity 70 in response to vertical movement of the scallop body 180 within the die support cavity.

The cam driver 226 has an annular vertical surface 228 for sliding engagement with the inner cylindrical surface 218 of the annular driving ring 212 and a cam surface 230 extending between top and bottom surfaces 232 and 234, respectively, of the cam driver. The keyed shaft 186 of the scallop body 180 is slidably received through a keyed aperture 236 in the cam driver 226. While the cam driver 226 is shown and described as being free floating within the die cavity 70, those skilled in the art will appreciate that the cam driver may be formed integrally at one end of the scallop body 180 as shown in an alternative embodiment of FIG. 12.

Preferably, a plurality of circumferentially spaced ball bearings 238 are provided in the die support cavity 70 between the cam surface 230 of the cam driver 226 and the cam surface 224 of the annular driving ring 212. As will be described in more detail with reference to FIGS. 7 and 9, the ball bearings 238, in combination with the cam surfaces 224 and 230 of the annular driving ring 212 and cam driver 226, respectively, act as converters to convert vertical movement of the cam driver in one direction into vertical movement of the annular driving member in an opposite direction within the die support cavity 70.

A plurality of circumferentially spaced rotary benders 240 are provided in the die support cavity 70 for purposes to be described in detail below with reference to FIGS. 7–9. The rotary benders 240 are supported on the cam surface 222 of the annular driving ring 212 beneath a retaining ring 242 mounted above the die support cavity 70. An annular ring 244 (see FIG. 8) having a plurality of tangs 246 extending between the rotary benders 240 is provided in the die support cavity 70 to maintain circumferential spacing of the rotary benders during operation of the apparatus 54 to make the tamper-evident crowns 20.

Having described the detailed construction and arrangement of the various cooperating component parts comprising the apparatus 54, the detailed description will now proceed with a description of the manner in which the apparatus is used to carry out the method of this invention to make the exemplary crown 20.

In particular, a suitable web or sheet of material, such as thin steel or aluminum and designated by reference numeral 72 in FIGS. 4–7, is provided between the upper and lower die sets 56 and 58 comprising components of a standard die press. The lower die set 58 comprises the fixed bed of the forming press while the upper die set 56 comprises the moving press ram whereby it will be appreciated that with this construction, the upper and lower die sets are relatively movable toward and away from each other.

As shown in FIGS. 3 and 4, with the sheet of material 72 interposed between the upper and lower die sets 56 and 58, the upper die set is moved toward the lower die set. That is, the vertical movement of the head punch drive plate 74 toward the lower die set 58 causes simultaneous vertical movement of the blanking punch drive plate 78 in the same direction whereupon the outer cutting surface 108 of the blanking punches 90 cooperates with the inner cutting surface 178 of the annular blanking members 174 to shear a plurality of flat blanks 106 as shown in FIG. 4A. At the completion of the blanking operation, vertical movement of the blanking punch drive plate 78 is terminated when the pins 102 abut the blanking punch drive plate as shown in FIG. 3. Simultaneously with this blanking operation to define the flat blanks 106, the stripper plate 94 clamps unused portions of the sheet of material 72 to maintain the material stationary during formation of the crowns 20.

Figure 10:
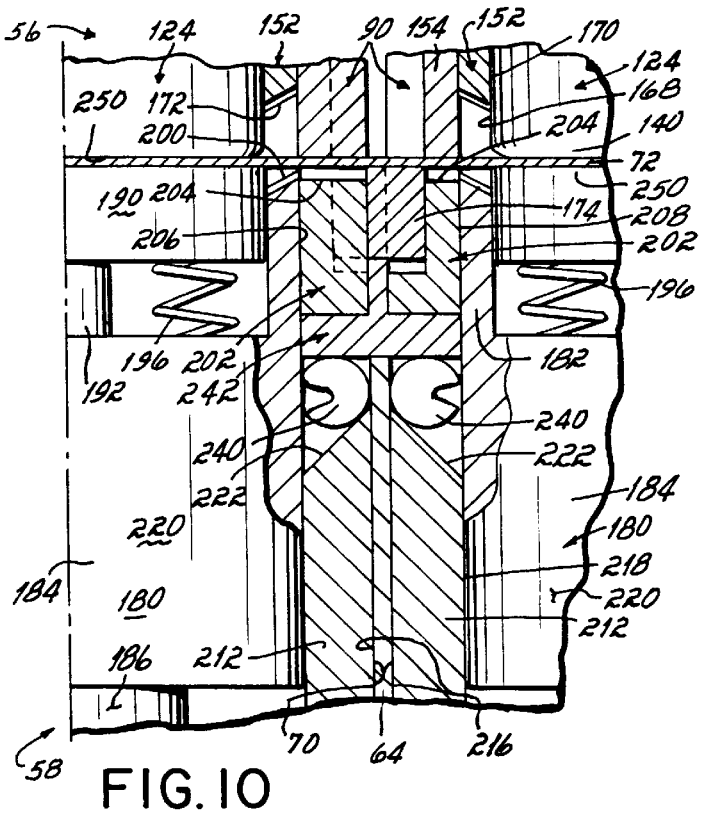
FIG. 10 is fragmentary cross-sectional view of two adjacent die structures, each configured to have operative components with an outer periphery of an extent no greater than the outer periphery of the crown blank.

To minimize material waste, adjacent die sets can be located closely together as illustrated in FIG. 10, where like numerals represent like components of the upper and lower die sets 56 and 58, respectively. Upper and lower die sets 56 and 58 are preferably ganged together in a cooperative matrix or pattern, e.g., having a spacing between outer peripheries of the adjacent die set components ranging between about 0.050" and about 0.100", so that operative components of each die set have an outer periphery of an extent no greater than the outer periphery of the flat blank 106 (see FIG. 4A). While spacing of the adjacent die set components within this range is preferred, those skilled in the art will appreciate that narrower or wider spacing of the die set components is possible for a particular application. It will also be appreciated by those skilled in the art that in this preferred configuration the blanking member 174 is a unitary piece common to all lower die sets 58 and is therefore not considered a part of any particular lower die set. Likewise, the retaining ring 242 is preferably common to all lower die sets 58. Accordingly, it will be appreciated that all remaining operative components of the upper and lower die sets 56 and 58, respectively, have outer peripheries of an extent no greater than the outer periphery of the flat blank 106.

As shown in FIG. 4A, the tabs 30 are elongate flat members having generally parallel spaced side edges 112 joined by transverse free edges 50. In a preferred embodiment, side edges 112 are not perfectly parallel but rather taper outwardly slightly from a tab width of 0.100" adjacent to the circumferential edge 115 of the blank 106 to a width of 0.110" at the free edge 50 of the tab 30. The central section of circular portion 116 forms the top wall 26 of the crown 20 while the annular surrounding section 248 forms the depending peripheral flange 28 having vertical wall portion 34, flared lower portion 36, ribs 38 and webs 40. Circumferential edge 115 of the blank 106 forms the lower circumferential edge 32 of the preformed crown 20. Tabs 30 extend outwardly from the circumferential edge 115, the tabs preferably being equally spaced about the circumference of the blank.

Referring to FIGS. 5 and 5A, formation of the crown 20 from the flat blank 106 commences with vertical movement of the head punch 92 and scallop ring 152 toward the support pad 190 and scallop body 180. The forming surface 138 of the head punch 92 cooperates with a forming surface 250 on the support pad 190 and the annular portion 182 of the scallop body 180 to bend the annular surrounding section 248 of the flat blank 106 along the dotted line 252 (see FIG. 4A) to form the top wall 26 and vertical wall portion 34 of the crown 20 as shown in FIG. 5A.

When the support pad 190 is urged against the body portion 184 of the scallop body 180 through compression of springs 196, the forming surface 250 of the support pad and the annular portion 182 of the scallop body form a crown cavity having the configuration of the top wall 26 and vertical wall portion 34 of the crown 20. While having the support pad 190 spring biased as shown and described is desirable to facilitate removal of the crown 20 after formation in apparatus 54, those skilled in the art will appreciate that the support pad may be removed and the crown cavity may be integrally formed in the scallop body 180 without departing from the spirit or scope of the present invention.

Simultaneously with movement of the head punch 92 toward the support pad 190, the scallop ring 152 travels vertically in the blanking punch 90. The forming surface 172 on the annular portion 154 of the scallop ring 152 cooperates with the forming surface 200 on the annular portion 182 of the scallop body 180 to form the plurality of ribs 38 and interconnecting webs 40 on the flared portion 36 of the peripheral flange 28, as shown in FIG. 5A.

Preferably, the scallop ring forming surface 172 is frusto-conically shaped and includes a plurality of rib projections and web depressions, shown generally by reference numeral 253 in the drawings, which cooperate with the scallop body forming surface 200 to form the ribs 38 and webs 40 on the flared portion 36. In alternative embodiments not shown, the forming surface 172 may be frusto-conically shaped but without rib projections and web depressions, or may be an annular horizontal surface.

At the completion of the crown forming operation shown in FIG. 5, the partially formed crown 20 has a top wall 26, a peripheral flange 28 including a vertical wall portion 34 and a flared portion 36, ribs 38 and interconnecting webs 40 in the flared portion, and a plurality of tabs 30 extending outwardly from the peripheral flange in a horizontal plane as shown in FIG. 5A.

With reference to FIGS. 6 and 6A, formation of the crown 20 in the apparatus 54 continues as the head punch 92 continues to travel vertically toward the support pad 190 and scallop body 180. In this operation, continued vertical movement of the head punch 92 causes the scallop body 180 and partially formed crown 20 to move vertically in the same direction within the die support cavity 70. The scallop ring 152 travels simultaneously with the head punch 92 within the blanking punch 90 until the horizontal shelf 164 of the scallop ring 152 abuts the horizontal shelf 122 of the blanking punch.

As the partially formed crown 20 moves vertically within the die support cavity 70, the forming surface 206 of the draw ring 202 bends the horizontally disposed tabs 30 (see FIG. 5A) in a direction away from the top wall 26 to extend in a plurality of vertical planes as shown in FIG. 6A. With the vertical movement of the scallop ring 152 stopped by the cooperation of the horizontal shelves 122 and 164, the forming surface 172 of the scallop ring 152 facilitates bending of the tabs 30 to the vertical position shown in FIG. 6A.

Now referring to FIG. 7, final formation of the crown 20 is shown as the head punch 92 travels vertically toward the scallop body 180 within the die support cavity 70. At the completion of the vertical stroke of the head punch 92 (i.e., when the pins 104 abut the head punch drive plate 74), the scallop body 180 imparts vertical movement to the cam driver 226 in the same direction within the die support cavity 70. The vertical movement of the cam driver 226 causes the cam surface 230 to impart a radially outward movement to the ball bearings 238. In turn, the radially outward movement to the ball bearings 238 imparts, through cam surface 224 of the annular driving ring 212, a vertical movement to the annular driving ring in an opposite direction relative to movement of the scallop body 180 within the die support cavity 70.

Referring to FIGS. 7–9, the rotary benders 240 of the present invention preferably comprise a plurality of circular discs spaced equally at one end of the die support cavity 70. The rotary benders or discs 240 have substantially parallel side faces 254 and a V-shaped groove 256 extending between the faces. The V-shaped groove 256 has an upper face 258 joined to a lower face 260 at a radiused apex 262 of the V-shaped groove. To facilitate inward movement of the rotary benders 240 toward the head punch 92, as shown most clearly in FIG. 8, the rotary benders have tapered faces 264 extending from the side faces 254 to the upper face 258.

As shown most clearly in FIGS. 7 and 9, at the end of the vertical stroke of the head punch 92, the cam surface 222 of the annular driving ring 212 is moved vertically, as represented by arrow 266, from a rest position shown generally by the dotted line 268 in FIG. 9 to the final position shown in the figure. The vertical movement of the annular driving ring 212 within the die cavity 70 imparts a radially inward movement of the rotary benders 240 as represented by arrow 270 and a simultaneous counterclockwise rotational movement to the rotary benders as shown by arrow 272. As the rotary benders 240 move radially and rotate as shown by arrows 270 and 272, the upper face 258 of the V-shaped groove 256 is brought into engagement with the vertically disposed tabs 30, shown schematically by dotted line 30' in FIG. 9. The radially inward movement and rotation of the rotary benders 240 bends the tabs 30 inwardly toward each other from the circumferential edge 32 of the flared portion 36 and preferably continuing slightly toward the top wall 26 as shown in FIGS. 7 and 9. That is, the rotary benders 240 preferably bend the tabs 30 toward the top wall 26 to extend in a direction which intersects a plane defined by the top wall of the crown 20 as is shown in the figures. The tabs 30 are further bent inwardly toward the top wall 26 upon application to the bottle finish 22 as shown most clearly in FIGS. 1 and 1A.

At the completion of the vertical stroke of the scallop body 180 within the die cavity 70, the air cylinder (not shown) attached to the keyed shaft 186 vents while the upper die set 56 retracts from the lower die set 58. When the blanking punch 90 and head punch 92 retract safely a predetermined distance from the lower die set 58, the air cylinder repressurizes to drive the scallop body 180 back to its initial rest position within the die support cavity 70. During this reverse motion of the upper and lower die sets 56 and 58, the ejector pin 146 extends through the forming surface 138 of the head punch 92 (see FIG. 2) and the support pad 190 extends from the scallop body 180 through springs 196 to facilitate ejection of the formed crown 20 from the apparatus 54.

Figure 11:
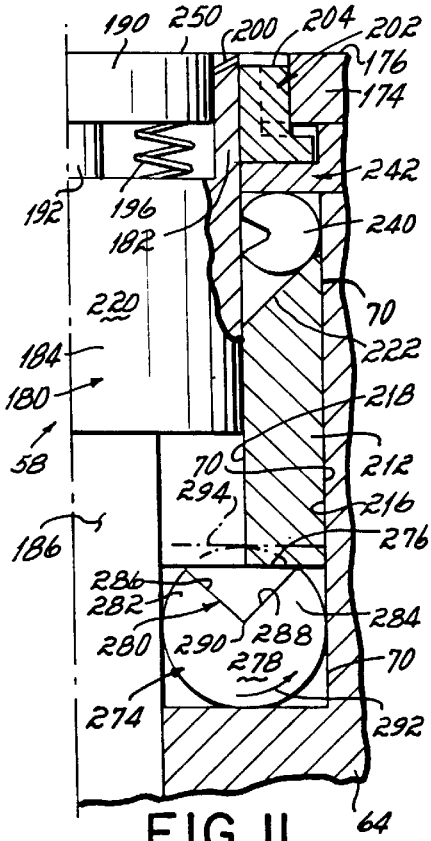
FIG. 11 is an alternative embodiment of the die structure of the present invention.

In an alternative embodiment shown in FIG. 11, where like numerals represent like components of the upper and lower die sets 56 and 58, the cam driver 226 and ball bearings 238 have been replaced with a plurality of rotary drivers 274 aligned radially within the die support cavity 70. Additionally, the cam surface 224 on the annular driving ring 212 has been replaced with a horizontal shelf 276 extending about the driving ring. The rotary drivers 274 have substantially parallel side faces 278 (one shown) and a V-shaped groove 280 extending between the faces to form inner and outer lobes 282 and 284, respectively. The V-shaped groove 280 has an inner face 286 associated with inner lobe 282 which is joined to an outer face 288 associated with outer lobe 284 at a normal apex 290 of the V-shaped groove.

In this embodiment, the horizontal shelf 276 of the annular driving ring 212 is supported on the outer lobe 284 of the rotary driver 274 while the inner lobe 282 extends radially inwardly beneath the scallop body 180. As the scallop body 180 travels vertically within the die cavity 70, the scallop body engages the inner lobe 282 of the rotary driver 274 which imparts a counterclockwise rotation to the rotary driver as shown by arrow 292 in the figure. As the rotary driver 274 rotates in response to vertical movement of the scallop body 180, the outer lobe 284 drives the annular driving ring 212 in an opposite vertical direction within the die support cavity 70 to a final position shown by the dotted line 294 corresponding to the same vertical movement of the annular driving ring 212 as shown by arrow 266 in FIG. 9 for bending the tabs 30 inwardly toward each other and preferably slightly toward the top wall 26 of the crown 20. The rotary drivers act as converters to convert vertical movement of the scallop body 180 in one direction into vertical movement of the annular driving ring 212 in an opposite direction within the die support cavity 70.

Figure 12:
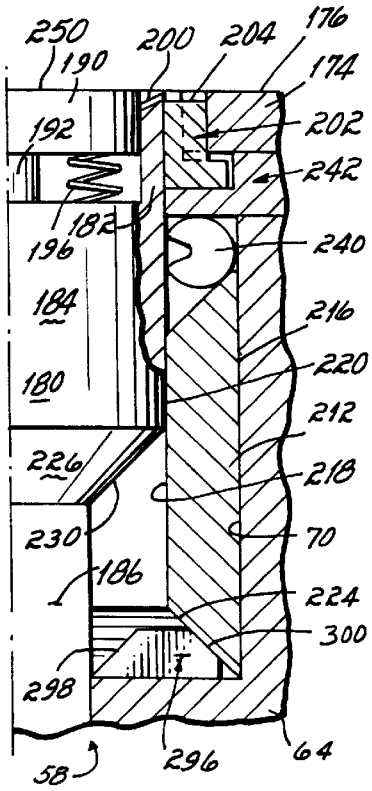
FIG. 12 is second alternative embodiment of the die structure of the present invention.

In another alternative embodiment as shown in FIG. 12, the ball bearings 238 have been replaced with a plurality of radially aligned cams 296 and the cam driver 226 is formed integrally on the scallop body 180. As the scallop body 180 travels vertically within the die support cavity 70, the cam surface 230 of the integral cam driver 226 engages a cam surface 298 on the radially aligned cams 296. In response to the vertical movement of the scallop body 180, the cams 296 are driven radially outwardly and a cam surface 300 on the radially aligned cams cooperates with the cam surface 224 on the annular driving ring 212 to impart an opposite vertical movement to the annular driving ring as achieved in FIG. 9 for bending the tabs 30 inwardly and preferably slightly toward the top wall 26 of the crown 20.

Figure 13:
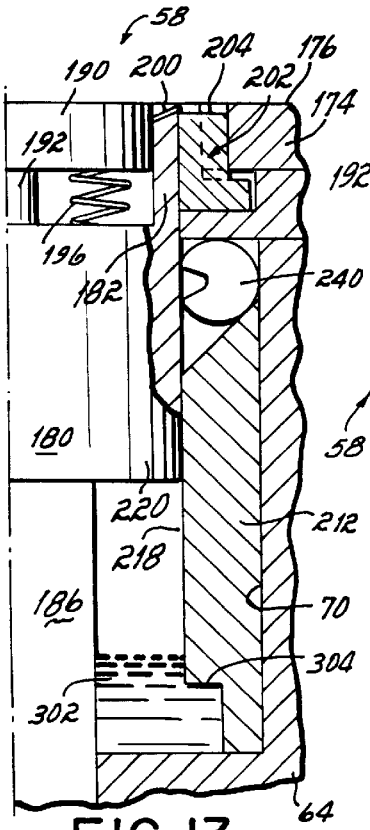
FIG. 13 is a third alternative embodiment of the die structure of the present invention.

In yet another embodiment shown in FIG. 13, the cam driver 226 and ball bearings 238 are replaced with a fluid shown schematically by numeral 302. The fluid 302 may comprise compressed air or hydraulic fluid which is disposed beneath the scallop body 180 and a marginal horizontal shelf 304 on the annular driving ring 212. While not shown, it will be appreciated that suitable gaskets are provided within the die support cavity 70 to prevent leakage of the fluid 302. In this embodiment, vertical movement of the scallop body 180 to the fluid 302 imparts an opposite vertical movement to the annular driving ring 212, as will be appreciated by those skilled in the art, to achieve the desired tab bending operation.

Figure 14:
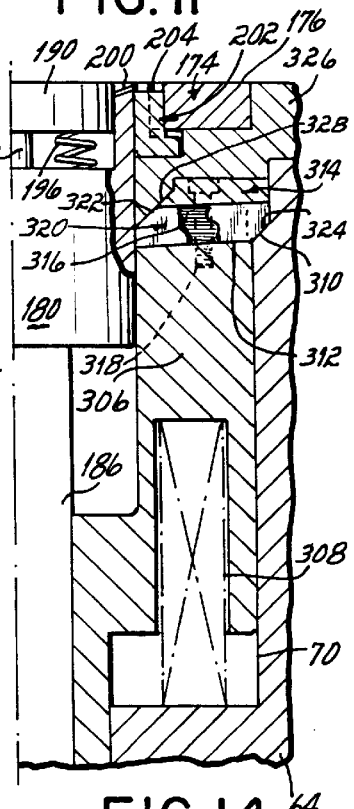
FIG. 14 is a fourth alternative embodiment of the die structure of the present invention.

In still another embodiment as shown in FIG. 14, the scallop body 180 is mounted for vertical movement within an annular body 306. The annular body 306 is mounted for vertical movement within the die support cavity 70 and is biased relative to the die support cavity through springs 308. The die support cavity 70 has an annular cam surface 310 circumscribing an annular inclined shelf 312 on the annular body 306. A slotted retaining ring 314 having a plurality of radially aligned slots 316 is mounted to the annular horizontal shelf 312 through fasteners 318 extending between the slots. A plurality of radially aligned cams 320 are slidably positioned in the slots 316 and include inner and outer cam surfaces 322 and 324, respectively. An upper retaining ring 326 is supported above the die support cavity 70 and includes an annular cam surface 328.

In this embodiment, as the annular body 306 moves vertically in the die support cavity 70 away from the upper retaining ring 326 in response to vertical movement of the scallop body 180 in the same direction, the outer cam surface 324 of the radially aligned cams 320 cooperates with the annular cam surface 310 of the die support cavity 70 to urge the cams 320 radially inwardly for bending the tabs 30 toward each other during formation of the crown 20. On the return vertical movement of the annular body 306 toward the upper retaining ring 326, the annular cam surface 328 of the upper retaining ring cooperates with the inner cam surface 322 of the radially aligned cams 320 to urge the cams 320 radially outwardly to their original position as shown in FIG. 14.

Those skilled in the art will appreciate that while various converter structures have been shown and described for converting relative movement of the upper and lower die sets 56 and 58 toward each other into movement of the annular driving ring 212, the invention in its broadest sense contemplates any mechanical, electrical, fluid or other converter structure for converting the relative movement of the upper and lower die sets 56 and 58 toward each other to an inward movement of the rotary benders 240, cams 320 or similar structures, for bending the tabs 30 inwardly toward each other and preferably slightly toward the top wall 26 during formation of the crown 20.

The method and apparatus of the present invention therefore provide for making the formed tamper-evident crown 20 having top wall 26, depending peripheral flange 28, and tabs 30 bent inwardly from lower circumferential edge 32 of the flange and preferably slightly toward the top wall, as shown most clearly in FIGS. 1, 1A, 7 and 9. The formed crown 20 is made from feed stock material 72 by the relative movement of the upper and lower die sets 56 and 58 toward each other during a single stroke operation of the die press. In accordance with the present invention, a plurality of the upper and lower dies sets 56 and 58 may be ganged together in a cooperative matrix or pattern for making a plurality of the formed crowns 20 from feed stock material 72 with minimal waste of the feed stock material during the formation operation.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made without departing from the spirit or scope of Applicant's invention, and Applicant intends to be bound only by the claims appended hereto.

I claim:

1. In a die structure for making a formed tamper-evident crown from a sheet of material, said formed crown having a top wall, a depending peripheral flange, and a plurality of tabs bent inwardly from said peripheral flange, said die structure comprising: first and second die sets moveable with respect to each other to form said crown, one of said die sets having a crown forming body disposed for movement within a die support cavity responsive to relative movement of said die sets toward each other, and a plurality of radially aligned rotary benders spaced circumferentially about one of said die support cavity, said rotary benders being movable responsive to movement of said crown forming body and bending said tabs inwardly toward each other during formation of said crown.

2. The die structure of claim 1 wherein a plurality of said first and second die sets are ganged together in a cooperative matrix for making a plurality of said formed crowns from a sheet of material supported between said first and second die sets.

3. The die structure of claim 2 wherein each of said first and second die sets includes operative components having an outer periphery of an extent no greater than the outer periphery of a flat blank cut from said sheet of material to form said crown.

4. The die structure of claim 1 wherein said depending peripheral flange includes a plurality of ribs and a plurality of webs interconnecting said ribs, said tabs being bent inwardly from said webs.

5. The die structure of claim 1 wherein said rotary benders are operable to bend said tabs inwardly toward each other to extend in a substantially horizontal plane.

6. The die structure of claim 1 wherein said rotary benders are operable to bend said tabs inwardly toward each other to extend in a direction intersecting a plane defined by said top wall.

7. In a die structure for making a formed tamper-evident crown from a sheet of material, said formed crown having a top wall, a depending peripheral flange, and a plurality of tabs bent inwardly from said peripheral flange, said die structure comprising: first and second die sets movable with respect to each other to form said crown, one of said die sets having a crown forming body disposed for movement within a die support cavity responsive to the relative movement of and disposed within said die sets toward each other, and a plurality of radially aligned cams spaced circumfererentially about one end of said die support cavity, said cams being movable responsive to movement of said crown forming body and bending said tabs inwardly toward each other during formation of said crown.

8. The die structure of claim 7 wherein a plurality of said first and second die sets are ganged together in a cooperative matrix for making a plurality of said formed crowns from a sheet of material supported between said first and second die sets.

9. The die structure of claim 8 wherein each of said first and second die sets includes operative components having an outer periphery of an extent no greater than the outer periphery of a flat blank cut from said sheet of material to form said crown.

10. The die structure of claim 7 wherein said depending peripheral flange includes a plurality of ribs and a plurality of webs interconnecting said ribs, said tabs being bent inwardly from said webs.

11. The die structure of claim 7 wherein said cams are operable to bend said tabs inwardly toward each other to extend in a substantially horizontal plane.

12. The die structure of claim 7 wherein said cams are operable to bend said tabs inwardly toward each other to extend in direction intersecting a plane defined by said top wall.

13. In a die structure for making a formed tamper-evident crown from a sheet of material, said formed crown having a top wall, a depending peripheral flange, and a plurality of tabs bent inwardly from said peripheral flange, said die structure comprising: first and second die sets movable with respect to each other to form said crown, one of said die sets having a crown forming body disposed for movement within a die support cavity in a first direction responsive to the relative movement of the die sets toward each other, a driving member circumscribing said crown forming body and disposed for movement in said die support cavity in a second direction responsive to movement of said crown forming body in said first direction, a converter underlying said crown forming body for imparting movement to said driving member in said second direction responsive to movement of said crown forming body in said first direction, and a plurality of movable bending members disposed within said die support cavity, said bending members being movable responsive to movement of said driving member in said second direction and bending said tabs inwardly toward each other during formation of said crown.

14. The die structure of claim 13 wherein a plurality of said first and second die sets are ganged together in a cooperative matrix for making a plurality of said formed crowns from a sheet of material supported between said first and second die sets.

15. The die structure of claim 14 wherein each of said first and second die sets includes operative components having an outer periphery of an extent no greater than the outer periphery of a flat blank cut from said sheet of material to form said crown.

16. The die structure of claim 13 wherein said converter underlying said closure forming body comprises a plurality of radially displaceable ball bearings.

17. The die structure of claim 13 wherein said converter underlying said closure forming body comprises a plurality of radially displaceable cams.

18. The die structure of claim 13 wherein said converter underlying said closure forming body comprises a plurality of radially aligned rotary drivers.

19. The die structure of claim 13 wherein said converter underlying said closure forming body comprises displaceable fluid.

20. The die structure of claim 19 wherein said fluid is selected from a group consisting of compressed air and hydraulic fluid.

21. The die structure of claim 13 wherein said plurality of movable bending members comprises a plurality of radially aligned rotary benders spaced circumferentially about one end of said die support cavity.

22. The die structure of claim 13 wherein said plurality of bending members comprises a plurality of radially aligned cams spaced circumferentially about one end of said die support cavity.

23. In a die structure for making a formed tamper-evident crown from a sheet of material, said formed crown having a top wall, a depending peripheral flange, and a plurality of tabs bent inwardly from said peripheral flange, said die structure comprising: first and second die sets movable with respect to each other to form said crown, one of said die sets having a blanking punch, a reciprocatory head punch slidably disposed within said blanking punch for movement therein, and a first forming member circumscribing said head punch and slidably disposed within said blanking punch for partial movement in cooperation with movement of said head punch in a first direction, said other die set having a crown forming body disposed for movement within a die support cavity in said first direction responsive to movement of said head punch and said first forming member in said first direction, a driving member circumscribing said crown forming body and disposed for movement in said die support cavity in a second direction responsive to movement of said crown forming body in said first direction, a converter underlying said crown forming body for imparting movement to said driving member in said second direction responsive to movement of said crown forming body in said first direction, and a plurality of movable bending members disposed within said die support cavity, said bending members being movable responsive to movement of said driving member in said second direction and bending said tabs inwardly toward each other during formation of said crown.

24. The die structure of claim 23 wherein a plurality of said first and second die sets are ganged together in a cooperative matrix for making a plurality of said formed crowns from a sheet of material supported between said first and second die sets.

25. The die structure of claim 24 wherein each of said first and second die sets includes operative components having an outer periphery of an extent no greater than the outer periphery of a flat blank cut from said sheet of material to form said crown.

26. The die structure of claim 23 wherein said converter underlying said closure forming body comprises a plurality of radially displaceable ball bearings.

27. The die structure of claim 23 wherein said converter underlying said closure forming body comprises a plurality of radially displaceable cams.

28. The die structure of claim 23 wherein said converter underlying said closure forming body comprises a plurality of radially aligned rotary drivers.

29. The die structure of claim 23 wherein said converter underlying said closure forming body comprises displaceable fluid.

30. The die structure of claim 29 wherein said fluid is selected from a group consisting of compressed air and hydraulic fluid.

31. The die structure of claim 23 wherein said plurality of movable bending members comprises a plurality of radially aligned rotary benders spaced circumferentially about one end of said die support cavity.

32. The die structure of claim 23 wherein said plurality of bending members comprises a plurality of radially aligned cams spaced circumferentially about one end of said die support cavity.

33. A die structure for making a formed tamper-evident crown from a sheet of material, said formed crown having a top wall, a depending peripheral flange, and a plurality of tabs bent inwardly from said peripheral flange comprising:

a first die set including, a blanking punch having an outer cutting surface;

a reciprocatory head punch slidably disposed within said blanking punch for movement therein and having a forming surface at one end thereof; and a first member circumscribing said head punch and slidably disposed within said blanking punch for partial movement in cooperation with movement of said head punch in a first direction, said first member having an annular forming surface at one end thereof; and a second die set including, a die support cavity underlying said first die set;

a blanking member supported above said die support cavity and having an inner cutting surface cooperating with said outer cutting surface of said blanking punch during movement of said blanking punch toward said blanking member to form a flat blank from said sheet of material supported between said first and second die sets;

a second member disposed for movement in said die support cavity and having an annular portion circumscribing a crown cavity and a body portion underlying said crown cavity, said forming surface of said head punch and said annular forming surface of said first member cooperating with said crown cavity and said annular portion of said second member during movement of said head punch and said first member in said first direction to form said top wall and said depending peripheral flange, said plurality of tabs extending outwardly from said peripheral flange in a substantially horizontal plane;

a draw ring having a forming surface disposed inwardly of said inner cutting surface of said blanking member for bending said horizontally disposed tabs in a direction away from said top wall to extend in a plurality of substantially vertical planes during movement of said head punch, said first member, and said second member within said die support cavity in said first direction;

a driving member circumscribing said second member and disposed for movement in said die support cavity in a second direction responsive to movement of said second member within said die support cavity in said first direction;

a converter underlying said second member for imparting said movement to said driving member in said second direction responsive to movement of said second member within said die support cavity in said first direction; and a plurality of movable bending members disposed within said die support cavity, said bending members being movable responsive to movement of said driving member in said second direction and bending said vertically disposed tabs inwardly toward each other during formation of said crown.

34. The die structure of claim 33 wherein a plurality of said first and second die sets are ganged together in a cooperative matrix for making a plurality of said formed crowns from a sheet of material supported between said first and second die sets.

35. The die structure of claim 34 wherein each of said first and second die sets includes operative components having an outer periphery of an extent no greater than the outer periphery of a flat blank cut from said sheet of material to form said crown.

36. A die structure for making a formed tamper-evident crown from a sheet of material, said formed crown having a top wall, a depending peripheral flange including a plurality of ribs and a plurality of webs interconnecting said ribs, and a plurality of tabs bent inwardly from said webs, comprising:

a first die set including, a blanking punch having an outer cutting surface;

a reciprocatory head punch slidably disposed within said blanking punch for movement therein and having a forming surface at one end thereof; and a first member circumscribing said head punch and slidably disposed within said blanking punch for partial movement in cooperation with movement of said head punch in a first direction, said first member having a plurality of rib projections and a plurality of web depressions interconnecting said rib projections at one end thereof; and a second die set including, a die support cavity underlying said first die set;

a blanking member supported above said die support cavity and having an inner cutting surface cooperating with said outer cutting surface of said blanking punch during movement of said blanking punch toward said blanking member to form a flat blank from said sheet of material supported between said first and second die sets;

a resiliently biased support pad underlying said head punch and disposed for movement in said die support cavity responsive to movement of said head punch in said first direction;

a second member disposed for vertical movement in said die support cavity and having an annular portion circumscribing said support pad and a body portion underlying said support pad, said annular portion and said support pad forming a crown cavity when said support pad is urged toward said body portion, said annular portion having a plurality of rib projections and a plurality of web depressions interconnecting said rib projections at one end thereof, said forming surface of said head punch cooperating with said support pad and said annular portion of said second member to form said top wall and said depending peripheral flange during movement of said head punch and said support pad in said first direction, said rib projections of said first and second members cooperating with said depressions of the other during movement of said first member in said first direction to form said plurality of vertical ribs and said plurality of webs interconnecting said ribs, said plurality of tabs extending outwardly from said webs in a substantially horizontal plane;

a draw ring having a forming surface disposed inwardly of said inner cutting surface of said blanking member for bending said horizontally disposed tabs in a direction away from said top wall to extend in a plurality of substantially vertical planes during movement of said head punch, said first member, said support pad, and said second member within said die support cavity in said first direction;

a driving member circumscribing said second member and disposed for movement in said die support cavity in a second direction responsive to movement of said second member within said die support cavity in said first direction;

a converter underlying said second member for imparting said movement to said driving member in said second direction responsive to movement of said second member within said die support cavity in said first direction; and a plurality of movable bending members disposed within said die support cavity, said bending members being movable responsive to movement of said driving member in said second direction and bending said vertically disposed tabs inwardly toward each other during formation of said crown.

37. A die structure for making a formed tamper-evident crown from a sheet of material, said formed crown having a top wall, a depending peripheral flange, and a plurality of tabs bent inwardly from said peripheral flange, comprising:

means for cutting a flat blank from said sheet of material, said flat blank having a circular portion and a plurality of outwardly extending tabs;

means for forming said circular portion to create said top wall and said peripheral flange, said plurality of tabs extending outwardly from said peripheral flange in a substantially horizontal plane;

means for bending said horizontally disposed tabs in a direction away from said top wall to extend in a plurality of substantially vertical planes; and a plurality of radially aligned rotary benders for bending said vertically disposed tabs inwardly toward each other during formation of said crown.

38. A method for making a formed tamper-evident crown from a sheet of material, said crown having a top wall, a depending peripheral flange including a substantially vertical first portion and a flared second portion, said flared second portion having a plurality of ribs and a plurality of webs interconnecting said ribs, and a plurality of tabs bent inwardly from said webs, the steps comprising:

cutting from said sheet of material a flat blank having a circular portion and a plurality of outwardly extending tabs;

forming a first segment of said circular portion to create said top wall and said substantially vertical first portion, said plurality of tabs extending outwardly from said peripheral flange in a substantially horizontal plane;

forming a second segment of said circular portion to create said flared second portion having said plurality of ribs and said plurality of webs interconnecting said ribs, said plurality of tabs extending outwardly from said webs in a substantially horizontal plane;

bending said horizontally disposed tabs in a direction away from said top wall to extend in a plurality of substantially vertical planes;

providing a plurality of radially aligned rotary benders; and moving said rotary benders radially inwardly to bend said vertically disposed tabs inwardly toward each other during formation of said crown.

39. The method of claim 38 further comprising the step of bending said plurality of tabs inwardly toward each other to extend in a substantially horizontal plane.

40. The method of claim 38 further comprising the step of bending said plurality of tabs inwardly toward each other to extend in a direction intersecting a plane defined by said top wall.

41. A die structure for making a formed tamper-evident crown from a sheet of material, said formed crown having a top wall, a depending peripheral flange, and a plurality of tabs bent inwardly from said peripheral flange, comprising:

means for cutting a flat blank from said sheet of material, said flat blank having a circular portion and a plurality of outwardly extending tabs;

means for forming said circular portion to create said top wall and said peripheral flange, said plurality of tabs extending outwardly from said peripheral flange in a substantially horizontal plane;

means for bending said horizontally disposed tabs in a direction away from said top wall to extend in a plurality of substantially vertical planes; and a plurality of radially aligned cams for bending said vertically disposed tabs inwardly toward each other during formation of said crown.

42. A method for making a formed tamper-evident crown from a sheet of material, said crown having a top wall, a depending peripheral flange including a substantially vertical first portion and a flared second portion, said flared second portion having a plurality of ribs and a plurality of webs interconnecting said ribs, and a plurality of tabs bent inwardly from said webs, the steps comprising:

cutting from said sheet of material a flat blank having a circular portion and a plurality of outwardly extending tabs;

forming a first segment of said circular portion to create said top wall and said substantially vertical first portion, said plurality of tabs extending outwardly from said peripheral flange in a substantially horizontal plane;

forming a second segment of said circular portion to create said flared second portion having said plurality of ribs and said plurality of webs interconnecting said ribs, said plurality of tabs extending outwardly from said webs in a substantially horizontal plane;

bending said horizontally disposed tabs in a direction away from said top wall to extend in a plurality of substantially vertical planes;

providing a plurality of radially aligned cams; and moving said cams radially inwardly to bend said vertically disposed tabs inwardly toward each other during formation of said crown.

43. The method of claim 42 further comprising the step of bending said plurality of tabs inwardly toward each other to extend in a substantially horizontal plane.

44. The method of claim 42 further comprising the step of bending said plurality of tabs inwardly toward each other to extend in a direction intersecting a plane defined by said top wall.

* * * * *

UNITED STATES PATENT AND TRADEMARK OFFICE

CERTIFICATE OF CORRECTION

PATENT NO. : 5,820,326

DATED : October 13, 1998

INVENTOR(S) : Mark E. Melson

It is certified that error appears in the above-identified patent and that said Letters Patent is hereby corrected as shown below:

Column 5, line 24, after "other", please insert --end--.

Column 13, line 56, after "one", please insert --end--.

Column 14, line 25, after "one end of", please insert --and disposed within--.

Column 14, line 48, after "extend in", please insert --a--.

Signed and Sealed this

Ninth Day of February, 1999

*Attest:*

*Acting Commissioner of Patents and Trademarks*

*Attesting Officer*